US009109273B2

(12) United States Patent
Jin et al.

(10) Patent No.: US 9,109,273 B2
(45) Date of Patent: Aug. 18, 2015

(54) HIGH STRENGTH STEEL SHEET AND HOT DIP GALVANIZED STEEL SHEET HAVING HIGH DUCTILITY AND EXCELLENT DELAYED FRACTURE RESISTANCE AND METHOD FOR MANUFACTURING THE SAME

(75) Inventors: Young Hoon Jin, Gwangyang (KR); Kwang Geun Chin, Gwangyang (KR); Seung Bok Lee, Gwangyang (KR); Jai Hyun Kwak, Gwangyang (KR)

(73) Assignee: POSCO, Pohang-Si (KR)

( * ) Notice: Subject to any disclaimer, the term of this patent is extended or adjusted under 35 U.S.C. 154(b) by 547 days.

(21) Appl. No.: 12/993,271

(22) PCT Filed: Sep. 1, 2008

(86) PCT No.: PCT/KR2008/005132
§ 371 (c)(1),
(2), (4) Date: Nov. 18, 2010

(87) PCT Pub. No.: WO2009/142362
PCT Pub. Date: Nov. 26, 2009

(65) Prior Publication Data

US 2011/0083774 A1 Apr. 14, 2011

(30) Foreign Application Priority Data

May 20, 2008 (KR) ..... 10-2008-0046718

(51) Int. Cl.

| | |
|---|---|
| ***C21D 8/02*** | (2006.01) |
| ***C22C 38/54*** | (2006.01) |
| ***C23C 2/28*** | (2006.01) |
| ***C22C 38/02*** | (2006.01) |
| ***C21D 6/00*** | (2006.01) |
| ***C21D 8/04*** | (2006.01) |
| ***C22C 38/06*** | (2006.01) |
| ***C22C 38/50*** | (2006.01) |
| ***C22C 38/58*** | (2006.01) |
| ***C22C 38/60*** | (2006.01) |
| *C21D 1/673* | (2006.01) |

(52) U.S. Cl.

CPC ..... *C22C 38/02* (2013.01); *C21D 6/005* (2013.01); *C21D 8/0436* (2013.01); *C21D 8/0473* (2013.01); *C22C 38/06* (2013.01); *C22C 38/50* (2013.01); *C22C 38/54* (2013.01); *C22C 38/58* (2013.01); *C22C 38/60* (2013.01); *C21D 1/673* (2013.01); *C21D 8/0478* (2013.01); *C21D 2211/001* (2013.01); *C21D 2211/005* (2013.01); *C21D 2211/008* (2013.01)

(58) Field of Classification Search

USPC ..... 148/328, 330, 333; 420/103, 104, 112
IPC .... C21D 1/673,2211/001, 2211/005, 2211/008, C21D 6/005
See application file for complete search history.

(56) References Cited

U.S. PATENT DOCUMENTS

| | | | | |
|---|---|---|---|---|
| 6,342,310 | B2 | 1/2002 | Hashimoto et al. | |
| 6,358,338 | B1 * | 3/2002 | Guelton et al. | 148/547 |
| 6,911,268 | B2 | 6/2005 | Takada et al. | |
| 7,416,615 | B2 | 8/2008 | Bano et al. | |
| 7,780,799 | B2 | 8/2010 | Goto et al. | |
| 2003/0116232 | A1 | 6/2003 | Marchionni et al. | |
| 2004/0202889 | A1 | 10/2004 | Fujita et al. | |
| 2005/0081966 | A1 | 4/2005 | Kashima et al. | |
| 2006/0137769 | A1 | 6/2006 | Yuse et al. | |
| 2006/0169367 | A1 | 8/2006 | Yuse et al. | |
| 2008/0070060 | A1 | 3/2008 | Suzuki et al. | |

FOREIGN PATENT DOCUMENTS

| | | | | |
|---|---|---|---|---|
| JP | 05070886 | A | | 3/1993 |
| JP | 07138345 | A | | 5/1995 |
| JP | 2001064750 | A | | 3/2001 |
| JP | 2001288550 | A | | 10/2001 |
| JP | 2002146477 | A | | 5/2002 |
| JP | 2002155317 | A | | 5/2002 |
| JP | 2002173737 | A | | 6/2002 |
| JP | 2002294397 | A | | 10/2002 |
| JP | 2003-138345 | A | * | 5/2003 |
| JP | 2003138345 | A | | 5/2003 |
| JP | 2004332099 | A | | 11/2004 |
| JP | 2004346362 | A | | 12/2004 |
| JP | 2005120436 | A | | 5/2005 |

(Continued)

OTHER PUBLICATIONS

Nagoya R&D Laboratory, Nippon Steel Corporation, "Effect of Microstructure on Formability and Delayed Cracking of Super High Strength Cold Rolled Steel Sheet", CAMP-ISIJ vol. 5 (1992), pp. 1839-1841 and English translation.

M. Nagumo, "Hydrogen related failure of steels—a new aspect", Materials Science and Technology, (Aug. 2004), vol. 20, 8; ProQuest Science Journals, pp. 940-950.

Berrahmoune, M.R. et al., "Delayed cracking in 301LN austenitic steel after deep drawing: Martensitic transformation and residual stress analysis", Materials Science & Engineering (2006), pp. 262-266.

*Primary Examiner* — Sikyin Ip

(74) *Attorney, Agent, or Firm* — The Webb Law Firm

(57) ABSTRACT

A cold rolled steel sheet and a hot dip galvanized steel sheet, which have high strength and elongation, such as a tensile strength of 980 MPa or more and an elongation of 28% or more, and excellent delayed fracture resistance, and manufacturing methods thereof. The cold rolled steel sheet has a composition including 0.05 to 0.3 weight percent C, 0.3 to 1.6 weight percent Si, 4.0 to 7.0 weight percent Mn, 0.5 to 2.0 weight percent Al, 0.01 to 0.1 weight percent Cr, 0.02 to 0.1 weight percent Ni and 0.005 to 0.03 weight percent Ti, 5 to 30 ppm B, 0.01 to 0.03 weight percent Sb, 0.008 weight percent or less S, balance Fe and impurities. The hot dip galvanized steel sheet has a hot dip galvanized layer or a hot dip galvannealed layer on the cold rolled steel sheet.

9 Claims, No Drawings

(56) References Cited

FOREIGN PATENT DOCUMENTS

| | | | |
|---|---|---|---|
| JP | 2005187837 | A | 7/2005 |
| JP | 2006037201 | A | 2/2006 |
| JP | 2006207019 | A | 8/2006 |
| JP | 2007039780 | A | 2/2007 |
| JP | 2007321168 | A | 12/2007 |
| KR | 19980045322 | A | 9/1998 |
| KR | 20000043762 | A | 7/2000 |
| KR | 20040037963 | A | 5/2004 |
| KR | 1020040088583 | A | 10/2004 |
| KR | 1020050032721 | A | 4/2005 |
| KR | 1020070067593 | A | 6/2007 |
| WO | 2007067014 | A1 | 6/2007 |
| WO | 2007074994 | A1 | 7/2007 |

* cited by examiner

HIGH STRENGTH STEEL SHEET AND HOT DIP GALVANIZED STEEL SHEET HAVING HIGH DUCTILITY AND EXCELLENT DELAYED FRACTURE RESISTANCE AND METHOD FOR MANUFACTURING THE SAME

TECHNICAL FIELD

The present invention relates to a high strength steel sheet mainly used as structural parts of a vehicle such as a bumper reinforcing member or a shock absorber inside a door, and more particularly, to a high strength steel sheet and a hot dip galvanized steel sheet, both of which have high ductility and excellent delayed fracture resistance by changing composition and improving heat treatment from those of conventional steel types, and manufacturing methods thereof.

BACKGROUND ART

Recently, a steel sheet for a vehicle requires higher level formability as shape of the vehicle are complicated and integrated. In particular, a bumper reinforcing member and a shock absorber inside a door are required to have high tensile strength and elongation since they closely relate to the safety of passengers of a vehicle in the case of collision. Thus, the bumper reinforcing member and the shock absorber are generally made of a high strength and high ductility steel sheet having a tensile strength of 780 MPa and an elongation 30% or more. As the problem of environmental pollution due to exhaust gas emission is recently rising, researches for light weight vehicles using high strength steel are increasing. However, high strength and high elongation increase the fraction of retained austenite, which has a disadvantage of relatively increasing delayed fracture.

Accordingly, the present invention aims to manufacture a steel sheet for vehicles having high strength and elongation, such as a tensile strength of 980 MPa or more and an elongation of 28% or more, and excellent delayed fracture resistance. A steel sheet containing a great amount of retained austenite for improving both strength and elongation has excellent uniform ductility. This is because retained austenite increases ductility while transforming into martensite when it is deformed. In addition, when localized compression is applied for example in a drawing stage, retained austenite transforming into martensite sharply increases necking resistance. Due to these properties, a cold rolled steel sheet and the like in which a (222) texture is not developed can be subjected to drawing. Therefore, the application of steel sheets containing a great amount of retained austenite having excellent ductility will greatly increase when they can be used as processing products which are subjected to drawing.

Steel sheets containing a great amount of retained austenite are manufactured by two conventional methods.

The first method is an austempering method, which involves adding a great amount of Si and Mn into low carbon steel to form austenite in an annealing stage and then holding a predetermined bainite temperature in a cooling stage to increase both strength and ductility. The retained austenite formed as above is caused to transform into martensite during plastic deformation, thereby increasing strength as well as ductility by alleviating stress concentration. This is referred to as Transformation Induced Plasticity (TRIP) and the resultant steel is used as high strength steel. A first method proposed by the present invention is to manufacture a steel sheet having a composition of the present invention by using the above described continuous annealing method.

The second method is an reverse transformation method, which reverse transforms martensite into austenite by reannealing Mn low carbon steel at a predetermined temperature after hot rolling. In this method, a mixed texture of martensite and bainite, obtained after the hot rolling, is subjected to cold rolling and then batch annealing to form austenite in lath boundaries of the entire texture, followed by cooling down and retaining at room temperature.

However, as is known up to the present, the steel sheet containing a great amount of retained austenite, manufactured according to the above method, has a problem of delayed fracture in which cracks occur as time passes after drawing (CAMP-ISIJ Vol. 5 (1992), 1841). The delayed fracture frequently occurs in high strength steel, such as a high tensile bolt in 1.2 GPa level, or austenite-based stainless steel. The delayed fracture is generally in the form of cracks, which are caused by the diffusion of hydrogen atoms or molecules under high residual stress (Material Science and Technology, Vol. 20 (2004), 940).

A steel sheet containing a great amount of retained austenite is subjected to delayed fracture since internal stress occurs in boundaries, caused by cubical expansion induced by transformation of retained austenite into martensite by a drawing stage, and concentration increases due to intrusion of hydrogen (Material Science and Engineering A 438-440 (2006), 262-266). In particular, since hydrogen diffusion rate is high and hydrogen solubility is low in a martensite structure, intrusion hydrogen easily collects in boundaries between martensite and retained austenite.

Japanese Laid-Open Patent Application No. 1993-070886 discloses a composition consisting of 0.05 to 0.3% C, 2.0% or less Si, 0.5 to 4.0% Mn, 0.1% or less P, 0.1% S, 0 to 5.0% Ni, 0.1 to 2.0% Al, and 0.01% or less N, where Si (%)+Al (%)≥0.5, and Mn (%)+⅓Ni (%)≥1.0, and also has a structure containing 5% or more retained austenite by volume. A steel slab having the above composition is hot-rolled, coiled at a temperature range from 300 to 720° C., and cold-rolled at a reduction rate from 30 to 80%. The resulting steel sheet is subjected, in the course of a subsequent continuous annealing stage, to heating up to a temperature in the region between Ac1 transformation point and Ac3 transformation point, and then subjected, in the course of cooling, to holding at a temperature range from 550 to 350° C. for 30 secs or more or to slow cooling at a cooling rate of 400° C./min or less. This technology belongs to the class of the continuous annealing, corresponding to the first method of the present invention. However, this technology is different from the present invention since added elements such as Mn, Ti, B and Sb are different and its mechanical properties are greatly less than those of the present invention.

Japanese Laid-Open Patent Application No. 2003-138345 discloses a composition consisting of, by mass, 0.06 to 0.20% C, 2.0% or less Si, and 3.0 to 7.0% Mn, and the balance Fe, in which the volume ratio of retained austenite is 10 to below 20%, and the area ratio of tempered martensite and tempered bainite is 30% or more. A steel ingot having the above composition is manufactured by hot rolling or cold rolling at a reduction rate of 20% or less, followed by tempering heat treatment of holding at 700° C. to (A1 point −50)° C. for 20 sec or less. The resultant steel has a tensile strength of 800 MPa and an elongation of about 30%. Compared with the present invention, this technology has a problem of delayed fracture due to the lack of Al and is different from the present invention with respect to hot finish rolling temperature, cold reduction rate and annealing holding time, and its mechanical properties are greatly less than those requested.

Japanese Laid-Open Patent Application No. Hei 07-138345 discloses a high strength steel sheet consisting of 2 to 6% Mn and 20% or more retained austenite. This steel sheet has a composition consisting of 0.1 to 0.4% C, 0.5% or less Si, 2.0 to 6.0% Mn, 0.005 to 0.1% Al. This steel sheet is produced by subjecting a hot rolled sheet or a cold rolled sheet, which is preliminarily heat-treated at a temperature range from 800 to 950° C. and then air-cooled or cooled at a cooling velocity equal to or higher than air cooling velocity, or a hot rolled sheet, prepared by hot rolling and coiling at a temperature range from 200 to 500° C., or a cold rolled sheet, prepared by cold-rolling this hot rolled sheet, to first-stage annealing at a temperature range from 650 to 750° C. for 1 minute or more, to cooling down to a temperature 500° C. or less, and successively to second-stage annealing at a temperature range from 650 to 750° C. for 1 minute or more. This technology is different from the present invention in that 20% or more retained austenite causes delayed fracture owing to transformation into martensite during drawing and Al for enhancing delayed fracture resistance is not added to the composition. Also with respect to annealing heat treatment, this technology performing the two annealing stages is different from the present invention performing one annealing stage.

While the above described technologies were developed in view of increasing the content of retained austenite in order to increase both strength and ductility, there have been no solutions to the probability of delayed fracture that increases with the amount of retained austenite. Therefore, there are required an alloy composition, which can increase the content of retained austenite as well as improve delayed fracture resistance in order to increase both strength and ductility, and a manufacturing method thereof.

SUMMARY OF THE INVENTION

The present invention has been devised to solve the foregoing problems with the conventional art related to a steel sheet having both high strength and high ductility, and one or more aspects of the present invention provide a cold rolled steel sheet and a hot dip galvanized steel sheet, which have improvement in delayed fracture resistance, a tensile strength of 980 PMa or more and an elongation of 28% or more by adding a suitable amount of Al for raising the stability of retained austenite and resistance against delayed fracture into an optimum composition that can increase the amount of retained austenite.

One or more aspects of the present invention provide a method of manufacturing a cold rolled steel sheet and a hot dip galvanized steel sheet, which have a tensile strength of 980 PMa or more, an elongation of 28% or more and excellent delayed fracture resistance.

In one or more aspects of the present invention, there are provided a high strength cold rolled steel sheet and a galvanized steel sheet, each of which consists of 0.05 to 0.3 weight percent C, 0.3 to 1.6 weight percent Si, 4.0 to 7.0 weight percent Mn, 0.5 to 2.0 weight percent Al, 0.01 to 0.1 weight percent Cr, 0.02 to 0.1 weight percent Ni and 0.005 to 0.03 weight percent Ti, 5 to 30 ppm B, 0.01 to 0.03 weight percent Sb, 0.008 weight percent or less S, balance Fe and impurities.

In one or more aspects of the present invention, there are provided a method of manufacturing a high strength cold rolled steel sheet and a method of manufacturing a galvanized steel sheet. Each of the method includes steps of: heating a steel slab having the above described composition at a temperature range from 1150 to 1250° C., followed by hot finish rolling at a temperature range from 880 to 920° C.; coiling the resultant structure at a temperature range from 550 to 650° C.; pickling the resultant structure using hydrochloric acid, followed by cold rolling at a cold reduction rate from 30 to 60%; and performing continuous annealing on the resultant structure by holding a temperature range from 670 to 750° C. for 60 seconds or more.

In one or more aspects of the present invention, there are provided a method of manufacturing a high strength cold rolled steel sheet and a method of manufacturing a galvanized steel sheet. Each of the method includes steps of: heating a steel slab at a temperature range from 1150 to 1250° C., followed by hot finish rolling at a temperature range from 880 to 920° C.; coiling the resultant structure at a temperature range from 550 to 650° C.; pickling the resultant structure using hydrochloric acid, followed by cold rolling at a cold reduction rate from 30 to 60%; performing reverse transformation by batch-annealing the resultant structure at a temperature range from 620 to 720° C. for 1 to 24 hours; and cooling the resultant structure at a cooling rate from 10 to 200° C./s.

According to one or more aspects of the present invention as set forth above, steel having the above described composition was manufactured according to the above described manufacturing conditions. This steel has a tensile strength of 980 MPa or more and an elongation of 28% or more, and particularly, has delayed fracture resistance improved by the addition of Al component. The steel sheet manufactured thereby can be used as reinforcing members and impact absorbers for vehicles, which are subjected to bending. Furthermore, this steel sheet can be deformed by a common level of drawing and thus can be made into some specific parts of the vehicles, which are made of 500 MPa level steel sheets. This can bring in effects such as the stability and lightweight of a vehicle body.

BEST MODE FOR CARRYING OUT THE INVENTION

The present invention relates to a high strength cold rolled steel sheet having excellent elongation and delayed fracture resistance and a manufacturing method thereof, wherein the high strength cold rolled steel sheet having a composition containing 0.05 to 0.3 weight percent C, 0.3 to 1.6 weight percent Si, 4.0 to 7.0 weight percent Mn, 0.5 to 2.0 weight percent Al, 0.01 to 0.1 weight percent Cr, 0.02 to 0.1 weight percent Ni and 0.005 to 0.03 weight percent Ti, 5 to 30 ppm B, 0.01 to 0.03 weight percent Sb, 0.008 weight percent or less S, the balance Fe and impurities.

Hereinafter the composition of the present invention will be described in detail (by weight percent).

The content of carbon (C) is in the range from 0.05% to 0.3%. C is the most important component in steel, which has close relations with all physical and chemical properties such as strength and ductility. In the steel sheet of the present invention, C has an effect on the formation of martensite or bainite having a lath texture after hot rolling, and on the amount and stability of austenite, which is formed during reverse transformation by batch annealing. The content of C is limited to the range from 0.05~0.3% since a C content under 0.05% decreases ductility and strength due to unstable formation of the lath texture and reduced stability of austenite after annealing but a C content exceeding 0.3% decreases workability due to increased cold rolling load and decreased weldability.

The content of silicon (Si) is in the range from 0.3 to 1.6%. Si acts to suppress the formation of carbide and thus ensure a predetermined amount of dissolved carbon, which is essential to Transformation Induced Plasticity (TRIP). Si is also added to facilitate the flotation of inclusion in a steel-making process while increasing the flowability of welding metal in welding. The content of Si is limited to the range from 0.3 to 1.6% since a Si content under 0.3% does not have an effect on inclusions and the formation of MnS in the steel-making process but a Si content exceeding 1.6% causes hot rolling scales and degrades plating (galvanizing) property and weldability.

The content of Mn is set to the range from 4.0 to 7.0%. Mn is added for effects of increasing hardenability to obtain a lath texture even in cooling conditions after hot coiling as well as extending the temperature range in which austenite is formed in the lath texture in reverse transformation by batch annealing. The cooling rate necessary for the formation of martensite is expressed by the following relation:

$$\log(\text{critical cooling rate, } ^\circ\text{C./s}) = 3.95 - 1.73 * (\text{Mn equivalent}),$$

where Mn equivalent=Mn %+0.45*Si %+2.67*Mo %. In the present invention, the Mn equivalent is at least 3.6% since the cooling rate after the coiling is 0.005° C./s or more. Mn is a component that increases strength by facilitating the formation of a low temperature transformation phase such as acicular ferrite and bainite. Mn is also a very effective element that stabilizes austenite to thereby facilitate the retaining of austenite formed in annealing. However, a Mn content exceeding 7% decreases weldability, changes the composition of steel making slag so as to increase the erosion of refractory members, and in a heating stage before hot rolling, forms Mn oxide in grain boundaries of a steel ingot adjacent to the surface thereby causing surface defects after the hot rolling. Furthermore, in the hot rolling, centerline segregation is formed in a steel slab thereby causing hydrogen embrittlement due to inclusions. Therefore, the Mn content is limited to the range from 4.0 to 7.0%.

The content of Al is limited to the range from 0.5 to 2.0%. Likewise the addition of Si, the addition of Al is to prevent delayed fracture and increase the amount of dissolved carbon in austenite. Delayed fracture is mainly caused by hydrogen adsorption due to increase in residual stress and dislocation density resulting from internal deformation, which occurs in boundaries when retained austenite transforms into martensite. In particular, the addition of high Mn greatly decreases the stacking fault energy inside steel to obstruct entangled dislocations from traveling, such that hydrogen can rarely escape from the core of the dislocations once adsorbed thereto, thereby increasing hydrogen concentration in the boundaries. Al is the most effective component for raising stacking fault energy. Specifically, Al relatively facilitates the motion of dislocations, such that hydrogen can easily escape from the core of the dislocations to thereby lower hydrogen concentration in the boundaries. However, at an Al content below 0.5%, the foregoing effects are rarely expectable. An Al content exceeding 2.0% facilitates the adsorption and escape of hydrogen but decreases the fraction of austenite, which relatively lowers ductility and thus degrades surface characteristics after galvanization.

The content of Ni is set to the range from 0.02 to 0.1%. Ni is an austenite stabilizing component, which has similar behavior to Mn. Ni increases the stability and fraction of retained austenite. Since a Ni content exceeding 0.1% greatly decreases the ductility of steel, the content of Ni of the present invention is limited to the range from 0.02 to 0.1%.

The content of Cr is set to the range from 0.01 to 0.1%. The addition of Cr aims to increase hardenability and strength. Since an improvement effect in quenching cannot be expected any further at a Cr content exceeding 0.1%, the content of Cr of the present invention is limited to the range from 0.01 to 0.1%.

The content of Ti is set to the range from 0.005 to 0.03%. Ti is a component ensuring that Al and B perform intended actions by precedently exhausting N in the form of TiN. Otherwise N would exhaust Al and B by forming AlN and BN. A Ti content below 0.005% can rarely perform the intended function, but a Ti content exceeding 0.03% is no more effective. Therefore, the content of Ti is limited to the range from 0.005 to 0.03%.

The content of B is set to the range from 5 to 30 ppm. B is a component improving hardenability even if added at a small amount into steel. B added at a content of 5 ppm or more precipitates in austenite grain boundaries at a high temperature so as to suppress the formation of ferrite thereby contributing to the improvement of hardenability. In contrast, B added at a content exceeding 30 ppm raises recrystallization temperature to thereby degrade weldability.

The content of Sb is set to the range from 0.01 to 0.03%. Sb improves surface characteristics when added at the suitable content from 0.01 to 0.03%. However, at a content exceeding 0.03%, Sb causes thickening to thereby worsen surface characteristics. Therefore, the Sb content of the present invention is limited to the range from 0.01 to 0.03%.

Below, manufacturing methods of the present invention will be described in detail.

In the present invention, a steel slab having the above-described composition is heated to a temperature range from 1150 to 1250° C., followed by hot finish rolling at a temperature range from 880 to 920° C. This corresponds to the heating temperature range of a steel slab that satisfies the composition of the present invention.

After the hot finishing rolling, coiling is carried out at a temperature ranging from 550 to 650° C. The coiling temperature is limited to the range from 550 to 650° C. owing to the following reasons. A coiling temperature under 550° C. worsens the slab geometry and increases the strength of the hot rolled sheet, thereby degrading workability in cold rolling. A coiling temperature exceeding 650° C. forms coarse bandlike bainite grains so as to cause non-uniformity to an annealed structure thereby degrading workability.

After the coiling, pickling using hydrochloric acid is performed, followed by cold rolling at a cold reduction rate from 30 to 60%. The cold reduction rate is limited to the range from 30 to 60% since thickness decreases little at a reduction rate under 30% but rolling is difficult owing to increasing rolling load at a reduction rate exceeding 60%.

After the cold rolling, two methods can be applied in the present invention. Below, a detailed description will be made of the two methods.

The first manufacturing method is aimed to be applied to continuous annealing.

After the cold rolling, the continuous annealing is carried out at a temperature range from 670 to 750° C. for 60 minutes or more. Since the time range applicable to the continuous annealing is preferably from 1 to 3 minutes, in which faster distribution reaction of C and Mn compared to batch annealing is required, the temperature ranging from 670 to 750° C. with high C and Mn diffusion rates is set as an annealing temperature. The temperature range is determined such that austenite is formed in a lath texture. Specifically, an annealing temperature under 670° C. makes it difficult to ensure a certain amount of C, which is required to stabilize austenite to increase strength and ductility. At an annealing temperature exceeding 750° C., austenite stability is not ensured since it is difficult to prevent carbide precipitation due to facilitated diffusion of Si and Al elements. Hence, the annealing temperature is limited to the range from 670 to 750° C. and austenite can reach an equilibrium state when a predetermined temperature within this temperature range is held for 60 seconds or more.

The continuous annealing is followed by a typical cooling stage, preferably, at a cooling rate from 5 to 50° C./s.

The second manufacturing method relates to reverse transformation by batch annealing, which is carried out as follows:

After the cold rolling, annealing is performed in a temperature range from 620 to 720° C. for 1 to 24 hours.

Generally, it is assumed that the batch annealing for reverse transformation holds an annealing temperature for about one hour and needs a process time that is several tens of times of the process time of continuous annealing. Therefore, the annealing temperature of this stage is somewhat different from that of the continuous annealing. The batch annealing for reverse transformation holds a lower temperature for a longer time than the continuous annealing does in order to ensure retained austenite. In this manufacturing method, at a temperature under 620° C., it is impossible in terms of commercialization to ensure a necessary time for carbon distribution. At a temperature of 720° C. or more, high ductility is not obtained since retained austenite becomes unstable by decomposition (carbide forming reaction) due to the long diffusion time of structural elements. Accordingly, the annealing temperature is limited to the range from 620 to 720° C.

The batch annealing time is required to be longer than the continuous annealing time and is a time necessary for realizing an equilibrium state in the annealing temperature. At a batch annealing time not exceeding one hour, a large amount of retained austenite is not obtained since the nucleation and growth of austenite are unstable. The upper limit is set 24 hours since austenite can sufficiently reach an equilibrium state in 24 hours and annealing beyond that time is economically inefficient.

The batch annealing is followed by cooling at a cooling rate from 10 to 200° C. When the amount of cold rolling increases, dislocations induced by the rolling also increases to an excessive amount, such that a lath texture, which was formed before the cold rolling, is destroyed by recrystallization behavior and thus austenite changes into short bar-shaped minute grains. Since these grains decrease elongation, the formation of recrystallization grains should be suppressed by cooling at a predetermined rate or more after the batch annealing. The lath texture should be held by accelerated cooling in order to ensure both strength and ductility. A cooling rate under 10° C./s per minute decreases workability, and a cooling rate exceeding 200° C./s per minute causes a shape abnormality in the slab due to the slab shape and irregular cooling and thereby causes surface oxidation by a large amount of cooling air. Accordingly, the cooling rate is limited to the range from 10 to 200° C./s.

The cold rolled steel sheet manufactured by the two methods as described above are subjected to hot dip galvanization or galvannealing.

The hot dip galvanization is preferably performed according to a common method in a galvanizing bath having a temperature range from 450 to 500° C. The galvanizing temperature is preferably 450° C. or more in order to maximize the bonding of the hot dip galvanization but is limited to 500° C. or less since a higher temperature may alloy the steel sheet.

After the hot dip galvanization, the hot dip galvannealing is performed when necessary. The hot dip galvannealing is carried out by a common method, preferably, at a temperature range from 500 to 600° C. The galvannealing temperature is preferably limited between 500 and 600° C. since alloying is not enough at a temperature under 500° C. and a hot dip galvannealed layer may evaporate from the surface of the steel sheet at a temperature exceeding 600° C.

The hot dip galvanized or galvannealed steel sheet according to the above the hot dip galvanization or galvannealing has a hot dip galvanized or galvannealed layer having a thickness of 10 μm or less.

Below, a description will be made of a texture of the present invention.

The cold rolled steel sheets manufactured by the two methods of the present invention have substantially the same texture. Each of the cold rolled steel sheets of the present invention consists of 40 to 50% annealed martensite as matrix, 20 to 40% retained austenite and balance ferrite. Particular, the present invention limits the amount of the retained austenite to the range from 20 to 40% in order to obtain high tensile strength and elongation.

The present invention will now be described in more detail with respect to following Examples.

EXAMPLES

Steel types were prepared according to compositions reported in Table 1 below. Eight (8) steel types A to H satisfy the composition range of the present invention, three (3) steel types I to K are beyond the composition range of the present invention.

TABLE 1

| Steel Type | C | Si | Mn | S | Cr | Ni | Al | Ti | B (ppm) | Sb |
|---|---|---|---|---|---|---|---|---|---|---|
| A | 0.025 | 0.98 | 6.69 | 0.001 | 0.019 | 0.054 | 1.56 | 0.015 | 10 | 0.02 |
| B | 0.053 | 1.00 | 6.75 | 0.001 | 0.020 | 0.053 | 1.53 | 0.018 | 15 | 0.02 |
| C | 0.109 | 0.96 | 6.71 | 0.001 | 0.019 | 0.053 | 1.57 | 0.020 | 10 | 0.018 |
| D | 0.151 | 0.94 | 6.74 | 0.001 | 0.019 | 0.053 | 1.57 | 0.014 | 14 | 0.021 |
| E | 0.021 | 0.45 | 6.44 | 0.002 | 0.018 | 0.050 | 1.48 | 0.018 | 20 | 0.022 |
| F | 0.045 | 0.45 | 6.43 | 0.002 | 0.019 | 0.049 | 1.48 | 0.020 | 18 | 0.02 |
| G | 0.098 | 0.49 | 6.57 | 0.002 | 0.018 | 0.051 | 1.52 | 0.016 | 16 | 0.02 |
| H | 0.144 | 0.50 | 6.56 | 0.002 | 0.019 | 0.050 | 1.49 | 0.015 | 15 | 0.016 |
| I | 0.025 | 0.95 | 6.23 | 0.001 | 0.018 | 0.051 | 0.04 | 0.015 | 17 | 0.02 |
| J | 0.102 | 0.98 | 6.54 | 0.001 | 0.018 | 0.053 | 0.04 | 0.014 | 18 | 0.021 |
| K | 0.149 | 0.56 | 6.12 | 0.002 | 0.019 | 0.049 | 0.06 | 0.106 | 20 | 0.02 |

Steel slabs according to the compositions reported in Table 1 above were heated to a temperature range from 1150 to 1250° C., followed by hot finishing rolling at a temperature range from 880 to 920° C., coiling at a temperature range from 550 to 650° C., pickling, and then cold rolling at a cold reduction rate from 30 to 60%.

Cold rolled steel sheets manufactured according to the above described method were subjected to continuous annealing according to process conditions including coiling times, annealing temperatures and annealing times as reported in Table 2 below:

TABLE 2

| No. | Steel type | Coiling temp.(° C.) | Annealing temp.(° C.) | Annealing time (sec) |
|---|---|---|---|---|
| 1-1 | A | 600 | 670 | 30 |
| 1-2 | | 600 | 670 | 63 |
| 1-3 | | 600 | 670 | 180 |
| 1-4 | | 600 | 670 | 1200 |
| 1-5 | | 610 | 770 | 60 |
| 2-1 | B | 630 | 720 | 30 |
| 2-2 | | 630 | 720 | 60 |
| 2-3 | | 630 | 720 | 180 |
| 2-4 | | 630 | 720 | 1200 |
| 2-5 | | 628 | 640 | 60 |
| 3-1 | C | 578 | 740 | 30 |
| 3-2 | | 578 | 740 | 60 |
| 3-3 | | 578 | 740 | 180 |
| 3-4 | | 578 | 740 | 1200 |
| 3-5 | | 590 | 600 | 60 |
| 4-1 | D | 580 | 680 | 60 |
| 4-2 | | 583 | 610 | 60 |
| 5-1 | E | 620 | 690 | 60 |
| 5-2 | | 610 | 780 | 60 |
| 6-1 | F | 600 | 700 | 60 |
| 6-2 | | 624 | 760 | 60 |
| 7-1 | G | 634 | 680 | 60 |
| 7-2 | | 627 | 600 | 60 |
| 8-1 | H | 583 | 670 | 60 |
| 8-2 | | 692 | 600 | 60 |
| 9-1 | I | 610 | 700 | 60 |
| 9-2 | | 602 | 780 | 60 |
| 10-1 | J | 605 | 680 | 60 |
| 10-2 | | 595 | 600 | 60 |
| 11-1 | K | 630 | 710 | 60 |
| 11-2 | | 638 | 630 | 60 |

The tensile strength, elongation and the crack length in delayed fracture of the cold rolled steel sheets manufactured according to the conditions of Table 2 above were measured and the results are reported in Table 3 below. To measure the crack length in delayed fracture reported in Table 3, disks having a 95 mm diameter were deformed and drawn into the shape of a cup using a punch having a 45 mm diameter and a flat head and the resultant structures were immersed into ethyl alcohol for three (3) and seven (7) days, respectively.

In Table 3, Inventive Steels were manufactured with the composition range of the present invention according to the manufacturing methods of the present invention, and Comparative Steels were prepared by hot rolling steel materials having the same composition range as Inventive Steels except for Al excluded, followed by treatment at different annealing temperatures.

TABLE 3

| No. | Steel type | Yield strength (MPa) | Tensile strength (MPa) | Total elongation (%) | Crack length in delayed fracture (mm) 3 days | 7 days | Remarks |
|---|---|---|---|---|---|---|---|
| 1-1 | A | 830 | 920 | 21.3 | 0 | 0 | CS[1)] 1 |
| 1-2 | | 836 | 1082 | 29.6 | 0 | 0 | IS[2)] 1 |
| 1-3 | | 831 | 1080 | 29.1 | 0 | 0 | IS 2 |
| 1-4 | | 843 | 1092 | 30.2 | 0 | 1 | IS 3 |
| 1-5 | | 989 | 1280 | 16.3 | 0 | 2 | CS 2 |
| 2-1 | B | 842 | 940 | 20.2 | 0 | 0 | CS 3 |
| 2-2 | | 841 | 1087 | 30.8 | 0 | 0 | IS 4 |
| 2-3 | | 852 | 1190 | 29.9 | 0 | 0 | IS 5 |
| 2-4 | | 849 | 1098 | 30.2 | 0 | 2 | IS 6 |
| 2-5 | | 819 | 992 | 15.1 | 0 | 1 | CS 4 |
| 3-1 | C | 851 | 966 | 22.4 | 0 | 0 | CS 5 |
| 3-2 | | 867 | 1196 | 30.6 | 0 | 2 | IS 7 |
| 3-3 | | 878 | 1112 | 30.1 | 0 | 0 | IS 8 |
| 3-4 | | 879 | 1098 | 29.8 | 0 | 0 | IS 9 |
| 3-5 | | 810 | 922 | 17.9 | 0 | 2 | CS 6 |
| 4-1 | D | 882 | 1109 | 30.7 | 0 | 2 | IS 10 |
| 4-2 | | 824 | 1056 | 20.4 | 0 | 0 | CS 7 |
| 5-1 | E | 828 | 1089 | 29.7 | 0 | 0 | IS 11 |
| 5-2 | | 938 | 1162 | 16.9 | 0 | 0 | CS 8 |
| 6-1 | F | 839 | 1097 | 30.6 | 0 | 2 | IS 12 |
| 6-2 | | 953 | 1124 | 15.7 | 0 | 1 | CS 9 |
| 7-1 | G | 842 | 1053 | 28.9 | 0 | 3 | IS 13 |
| 7-2 | | 792 | 929 | 17.5 | 0 | 3 | CS 10 |
| 8-1 | H | 898 | 1032 | 30.2 | 0 | 0 | IS 14 |
| 8-2 | | 804 | 952 | 18.9 | 0 | 0 | CS 11 |
| 9-1 | I | 922 | 1199 | 28.9 | 20 | 21 | CS 12 |
| 9-2 | | 983 | 1223 | 14.4 | 19 | 19 | CS 12 |
| 10-1 | J | 889 | 1103 | 30.9 | 23 | 25 | CS 14 |
| 10-2 | | 852 | 972 | 19.8 | 14 | 16 | CS 15 |
| 11-1 | K | 897 | 1174 | 29.2 | 21 | 21 | CS 16 |
| 11-2 | | 912 | 1053 | 22.9 | 18 | 19 | CS 17 |

Note)
CS[1)]: Comparative Steel,
IS[2)]: Inventive Steel

In addition, steel slabs having the composition range reported in Table 1 were heated at a temperature range from 1150 to 1250° C., followed by hot finish rolling at a temperature range from 880 to 920° C., coiling at a temperature range from 550 to 650° C., pickling, and then cold rolling at a cold reduction rate from 30 to 60%.

The cold rolled steel sheets manufactured according to the above described method were subjected to reverse transformation by batch annealing at coiling temperatures, annealing temperatures, annealing times and cooling temperatures as reported in Table 4 below.

TABLE 4

| No. | Steel type | Coiling temp. (° C.) | Annealing temp. (° C.) | Annealing time (hr) | Cooling rate (° C./min) |
|---|---|---|---|---|---|
| 1-1 | A | 600 | 650 | 0.5 | 50 |
| 1-2 | | 600 | 650 | 1 | 50 |
| 1-3 | | 600 | 650 | 5 | 50 |
| 1-4 | | 600 | 650 | 12 | 50 |
| 1-5 | | 610 | 750 | 1 | 50 |
| 2-1 | B | 630 | 670 | 0.5 | 50 |
| 2-2 | | 630 | 670 | 1 | 50 |
| 2-3 | | 630 | 670 | 5 | 50 |
| 2-4 | | 630 | 670 | 12 | 50 |
| 2-5 | | 628 | 600 | 1 | 50 |
| 3-1 | C | 578 | 680 | 0.5 | 50 |
| 3-2 | | 578 | 680 | 1 | 50 |
| 3-3 | | 578 | 680 | 5 | 50 |
| 3-4 | | 578 | 680 | 12 | 50 |
| 3-5 | | 590 | 740 | 1 | 50 |
| 4-1 | D | 580 | 660 | 5 | 50 |
| 4-2 | | 583 | 610 | 5 | 50 |
| 5-1 | E | 620 | 690 | 5 | 50 |
| 5-2 | | 610 | 750 | 5 | 50 |
| 6-1 | F | 600 | 700 | 5 | 50 |
| 6-2 | | 624 | 760 | 5 | 50 |
| 7-1 | G | 634 | 640 | 5 | furnace cooling |
| 7-2 | | 627 | 600 | 5 | furnace cooling |
| 8-1 | H | 583 | 630 | 5 | furnace cooling |
| 8-2 | | 692 | 600 | 5 | furnace cooling |

TABLE 4-continued

| No. | Steel type | Coiling temp. (° C.) | Annealing temp. (° C.) | Annealing time (hr) | Cooling rate (° C./min) |
|---|---|---|---|---|---|
| 9-1 | I | 610 | 650 | 5 | 50 |
| 9-2 | | 602 | 750 | 5 | 50 |
| 10-1 | J | 605 | 630 | 5 | 50 |
| 10-2 | | 595 | 600 | 5 | 50 |
| 11-1 | K | 630 | 700 | 5 | furnace cooling |
| 11-2 | | 628 | 640 | 5 | furnace cooling |

Table 5 show the results of measuring the tensile strength, elongation and crack length in delayed fracture of Inventive Steels and Comparative Steels after the reverse transformation by batch annealing. The property evaluation of the crack length in delayed fracture was performed in the same manner as above.

TABLE 5

| No. | Steel type | Yield strength (MPa) | Tensile strength (MPa) | Total elongation (%) | Crack length in delayed fracture (mm) 3 days | 7 days | Remarks |
|---|---|---|---|---|---|---|---|
| 1-1 | A | 830 | 920 | 25.3 | 0 | 1 | CS[1)] 1 |
| 1-2 | | 736 | 982 | 35.2 | 0 | 0 | IS[2)] 1 |
| 1-3 | | 731 | 980 | 37.1 | 0 | 1 | IS 2 |
| 1-4 | | 743 | 992 | 36.2 | 0 | 0 | IS 3 |
| 1-5 | | 789 | 880 | 24.3 | 0 | 0 | CS 2 |
| 2-1 | B | 842 | 940 | 24.2 | 0 | 0 | CS 3 |
| 2-2 | | 741 | 987 | 36.8 | 0 | 0 | IS 4 |
| 2-3 | | 752 | 990 | 35.9 | 0 | 0 | IS 5 |
| 2-4 | | 749 | 1001 | 35.3 | 0 | 1 | IS 6 |
| 2-5 | | 798 | 852 | 25.1 | 0 | 2 | CS 4 |
| 3-1 | C | 851 | 966 | 22.4 | 0 | 0 | CS 5 |
| 3-2 | | 767 | 996 | 37.6 | 0 | 1 | IS 7 |
| 3-3 | | 781 | 1012 | 36.1 | 0 | 0 | IS 8 |
| 3-4 | | 779 | 998 | 36.4 | 0 | 1 | IS 9 |
| 3-5 | | 780 | 882 | 24.9 | 0 | 0 | CS 6 |
| 4-1 | D | 782 | 1009 | 39.9 | 0 | 2 | IS 10 |
| 4-2 | | 764 | 956 | 29.4 | 0 | 0 | CS 7 |
| 5-1 | E | 728 | 989 | 34.5 | 0 | 0 | IS 11 |
| 5-2 | | 778 | 962 | 26.9 | 0 | 0 | CS 8 |
| 6-1 | F | 739 | 991 | 35.6 | 0 | 1 | IS 12 |
| 6-2 | | 753 | 953 | 27.8 | 0 | 1 | CS 9 |
| 7-1 | G | 842 | 943 | 26.4 | 0 | 0 | CS 10 |
| 7-2 | | 792 | 919 | 28.5 | 0 | 0 | CS 11 |
| 8-1 | H | 798 | 932 | 25.7 | 0 | 0 | CS 12 |
| 8-2 | | 834 | 952 | 27.9 | 0 | 2 | CS 13 |
| 9-1 | I | 752 | 999 | 27.3 | 22 | 24 | CS 14 |
| 9-2 | | 783 | 923 | 26.4 | 18 | 19 | CS 15 |
| 10-1 | J | 789 | 1003 | 36.9 | 21 | 23 | CS 16 |
| 10-2 | | 852 | 972 | 27.8 | 15 | 18 | CS 17 |
| 11-1 | K | 797 | 934 | 25.8 | 24 | 27 | CS 18 |
| 11-2 | | 812 | 951 | 24.9 | 16 | 17 | CS 19 |

Note)
CS[1)]: Comparative Steel,
IS[2)]: Inventive Steel

Inventive Steels manufactured according to the two manufacturing methods of the present invention had excellent properties with their elongation increased for about 8 to 10% compared to that of Comparative Steels when they had the same composition and were treated at an annealing temperature within the range of the present invention. Especially, when Inventive Steels and Comparative Steels to which Al component is not added were processed in the same manufacturing method, their tensile strength and elongation were similar but the crack length in delayed fracture was significantly different. While the crack length in delayed fracture of Inventive Steels was substantially zero (0) mm even after 3 and 7 days passed (good delayed fracture resistance), the crack length in delayed fracture of Comparative Steels was from 15 to 20 mm after 3 and 7 days passed. From these results, it can be appreciated that the addition of Al into the composition of Inventive Steels improves delayed fracture resistance.

As described above, when Inventive Steels having the composition of the present invention were manufactured by the two manufacturing methods of the present invention, all Inventive Steels had a tensile strength of 980 MPa or more, an elongation of 28% or more and excellent delayed fracture resistance. Thus, the steel sheets of the present invention have more excellent ductility as well as improved workability compared to conventional high strength steel sheets. Especially, the steel sheets of the present invention can be deformed by drawing due to improved behavior related to delayed fracture, which is a disadvantage of high strength steel sheets having high fraction of retained austenite.

The invention claimed is:

1. A high strength cold rolled steel sheet comprising, by weight percent, 0.05 to 0.3% C, 0.3 to 1.6% Si, 4.0 to 7.0% Mn, 0.5 to 2.0% Al, 0.01 to 0.1% Cr, 0.02 to 0.1% Ni and 0.005 to 0.03% Ti, 5 to 30 ppm B, 0.01 to 0.03% Sb, 0.008% or less S, balance Fe and impurities, and comprising a microtexture including 40 to 50% by area fraction of annealed martensite as a matrix, 20 to 40% by volume fraction of retained austenite and balance ferrite.

2. The high strength cold rolled steel sheet of claim 1, having a tensile strength of 980 MPa or more and an elongation of 28% or more.

3. A high strength galvanized steel sheet comprising:

a steel including, by weight percent, 0.05 to 0.3% C, 0.3 to 1.6% Si, 4.0 to 7.0% Mn, 0.5 to 2.0% Al, 0.01 to 0.1% Cr, 0.02 to 0.1% Ni and 0.005 to 0.03% Ti, 5 to 30 ppm B, 0.01 to 0.03% Sb, 0.008% or less S, balance Fe and impurities, and comprising a microtexture including 40 to 50% by area fraction of annealed martensite as a matrix, 20 to 40% by volume fraction of retained austenite and balance ferrite; and a galvanized layer or a galvannealed layer.

4. A method of manufacturing a high strength cold rolled steel sheet, comprising:

heating a steel slab at a temperature range from 1150 to 1250° C., followed by hot finish rolling at a temperature range from 880 to 920° C., the steel slab including, by weight percent, 0.05 to 0.3% C, 0.3 to 1.6% Si, 4.0 to 7.0% Mn, 0.5 to 2.0% Al, 0.01 to 0.1% Cr, 0.02 to 0.1% Ni and 0.005 to 0.03% Ti, 5 to 30 ppm B, 0.01 to 0.03% Sb, 0.008% or less S, balance Fe and impurities, and comprising a microtexture including 40 to 50% by area fraction of annealed martensite as a matrix, 20 to 40% by volume fraction of retained austenite and balance ferrite;

coiling the resultant structure at a temperature range from 550 to 650° C.;

pickling the resultant structure using hydrochloric acid, followed by cold rolling at a cold reduction rate from 30 to 60%; and performing continuous annealing on the resultant structure by holding a temperature range from 670 to 750° C. for 60 seconds or more, followed by cooling.

5. A method of manufacturing a high strength cold rolled steel sheet, comprising:

heating a steel slab at a temperature range from 1150 to 1250° C., followed by hot finish rolling at a temperature range from 880 to 920° C., the steel slab including, by weight percent, 0.05 to 0.3% C, 0.3 to 1.6% Si, 4.0 to 7.0% Mn, 0.5 to 2.0% Al, 0.01 to 0.1% Cr, 0.02 to 0.1% Ni and 0.005 to 0.03% Ti, 5 to 30 ppm B, 0.01 to 0.03% Sb, 0.008% or less S, balance Fe and impurities, and comprising a microtexture including 40 to 50% by area fraction of annealed martensite as a matrix, 20 to 40% by volume fraction of retained austenite and balance ferrite;

coiling the resultant structure at a temperature range from 550 to 650° C.;

pickling the resultant structure using hydrochloric acid, followed by cold rolling at a cold reduction rate from 30 to 60%;

performing reverse transformation by batch-annealing the resultant structure at a temperature range from 620 to 720° C. for 1 to 24 hours; and cooling the resultant structure at a cooling rate from 10 to 200° C./s.

6. A method of manufacturing a high strength galvanized steel sheet, comprising:

heating a steel slab at a temperature range from 1150 to 1250° C., followed by hot finish rolling at a temperature range from 880 to 920° C., the steel slab including, by weight percent, 0.05 to 0.3% C, 0.3 to 1.6% Si, 4.0 to 7.0% Mn, 0.5 to 2.0% Al, 0.01 to 0.1% Cr, 0.02 to 0.1% Ni and 0.005 to 0.03% Ti, 5 to 30 ppm B, 0.01 to 0.03% Sb, 0.008% or less S, balance Fe and impurities, and comprising a microtexture including 40 to 50% by area fraction of annealed martensite as a matrix, 20 to 40% by volume fraction of retained austenite and balance ferrite;

coiling the resultant structure at a temperature range from 550 to 650° C.;

pickling the resultant structure using hydrochloric acid, followed by cold rolling at a cold reduction rate from 30 to 60%;

performing continuous annealing on the resultant structure by holding a temperature range from 670 to 750° C. for 60 seconds or more, followed by cooling; and galvanizing the resultant structure at a temperature range from 450 to 500° C.

7. A method of manufacturing a high strength galvanized steel sheet of claim 6, further comprising:

galvannealing the resultant structure at a temperature range from 500 to 600° C.

8. A method of manufacturing a high strength galvanized steel sheet, comprising:

heating a steel slab at a temperature range from 1150 to 1250° C., followed by hot finish rolling at a temperature range from 880 to 920° C., the steel slab including, by weight percent, 0.05 to 0.3% C, 0.3 to 1.6% Si, 4.0 to 7.0% Mn, 0.5 to 2.0% Al, 0.01 to 0.1% Cr, 0.02 to 0.1% Ni and 0.005 to 0.03% Ti, 5 to 30 ppm B, 0.01 to 0.03% Sb, 0.008% or less S, balance Fe and impurities, and comprising a microtexture including 40 to 50% by area fraction of annealed martensite as a matrix, 20 to 40% by volume fraction of retained austenite and balance ferrite;

coiling the resultant structure at a temperature range from 550 to 650° C.;

pickling the resultant structure using hydrochloric acid, followed by cold rolling at a cold reduction rate from 30 to 60%;

performing reverse transformation by batch-annealing the resultant structure at a temperature range from 620 to 720° C. for 1 to 24 hours;

cooling the resultant structure at a cooling rate from 10 to 200° C./s; and galvanizing the resultant structure at a temperature range from 450 to 500° C.

9. A method of manufacturing a high strength galvanized steel sheet of claim 8, further comprising:

galvannealing the resultant structure at a temperature range from 500 to 600° C.

* * * * *